US006630909B2

(12) United States Patent
Nepveu

(10) Patent No.: US 6,630,909 B2
(45) Date of Patent: Oct. 7, 2003

(54) MEANDER LINE LOADED ANTENNA AND METHOD FOR TUNING

(76) Inventor: Raymond R. Nepveu, P.O. Box 127, Ossippee, NH (US) 03864

( * ) Notice: Subject to any disclaimer, the term of this patent is extended or adjusted under 35 U.S.C. 154(b) by 1 day.

(21) Appl. No.: 09/920,172

(22) Filed: Aug. 1, 2001

(65) Prior Publication Data

US 2003/0025634 A1 Feb. 6, 2003

(51) Int. Cl.[7] ..... H01Q 11/12; H01Q 1/38

(52) U.S. Cl. ..... 343/744; 343/700 MS

(58) Field of Search ..... 343/895, 700 MS, 343/744, 745, 749, 731, 748, 788; H01Q 11/12, 1/38

(56) References Cited

U.S. PATENT DOCUMENTS 4,251,817 A * 2/1981 Kimura et al. ..... 342/175
4,255,730 A * 3/1981 Sekine et al. ..... 333/247
4,367,474 A * 1/1983 Schaubert et al. ... 343/700 MS
4,379,296 A * 4/1983 Farrar et al. ..... 343/700 MS
4,529,987 A * 7/1985 Bhartia et al. ..... 343/700 MS
4,777,490 A * 10/1988 Sharma et al. ..... 343/754
4,780,724 A * 10/1988 Sharma et al. ..... 343/700 MS
5,113,196 A * 5/1992 Ponce de Leon et al. .. 343/702
5,790,080 A 8/1998 Apostolos ..... 343/744
6,323,814 B1 * 11/2001 Apostolos ..... 343/741
6,329,959 B1 * 12/2001 Varadan et al. ..... 343/787
6,333,719 B1 * 12/2001 Varadan et al. ..... 333/161
6,384,792 B2 * 5/2002 Apostolos ..... 343/744
2001/0035842 A1 * 11/2001 Apostolos ..... 343/700 MS
2001/0048396 A1 * 12/2001 Apostolos ..... 343/700 MS

* cited by examiner

*Primary Examiner*—Don Wong
*Assistant Examiner*—Trinh Vo Dinh
(74) *Attorney, Agent, or Firm*—McLane, Graf, Raulerson & Middleton, PA

(57) ABSTRACT

The present invention offers an alternative method of tuning a meander line antenna. A layer of PN semiconductor material is inserted between a ground plane and a base element. A dc voltage is applied between the ground plane and the base element. A change in capacitance between the ground plane and the base element is effected. The impedance of the base element is thus changed, resulting in a change in the delay through the meander line tuning module as the propagation constant. This change in delay tunes the meander line antenna in the same manner as discrete switch elements by adjusting only a single voltage.

3 Claims, 2 Drawing Sheets

PROPAGATION CONSTANT $\beta = \beta_0/2\sqrt{z_1/z_2}$

WHERE $\beta_0 = 2\pi/\lambda_0$

MEANDER LINE LOADED ANTENNA AND METHOD FOR TUNING

FIELD OF THE INVENTION

This invention relates to the field of meander line loaded antennas and, in particular, to methods for tuning the same.

BACKGROUND OF THE INVENTION

It is well known in the art that antenna performance is dependent upon the relationship between antenna length and the wavelength of the desired frequency of operation. This relationship determines the operating mode of the antenna, which modes are labeled as fractional parts of the wavelength. It is further known that the electrical length of an antenna may be considerably changed by the series connection of a coil therewith.

The proliferation of wireless communication devices drives a constant physical need for smaller, less obtrusive, and more efficient antennas. U.S. Pat. No. 5,790,080, issued to Apostolos, addresses this need, disclosing an antenna design with improved efficiency in terms of size or form factor versus electrical performance. An antenna is provided comprising: one or more conductive elements for acting as radiating antenna elements, and a slow wave meander line means adapted to couple electrical signals between the conductive elements, wherein the meander line means has an effective electrical length which affects the electrical length and operating characteristics of the antenna.

The antenna includes sequential low and higher impedance sections interconnected by substantially orthogonal sections, and by diagonal sections. This arrangement allows the construction of shorting switches between the adjacent low and higher impedance sections to provide for electronically switchable control of the length of the meander line and thus the center frequency of the attached antenna. These switches may take any suitable form, such as mechanical switches or electronically controllable switches such as pin diodes.

Essentially this design relies on discrete switch elements to short out sections of the meander line tuning module. The frequency of operation is thus changed by changing the net time delay through the module. A multiplicity of switches and their attending complex control circuitry is needed to tune the meander line antenna. Therefore, what is needed is a more efficient way to tune a meander line antenna. A method of tuning involving adjusting only one voltage is also needed.

SUMMARY OF THE INVENTION

The present invention offers an alternative method of tuning a meander line antenna. A layer of PN semiconductor material is inserted between a ground plane and a base element. A dc voltage is applied between the ground plane and the base element. A change in capacitance between the ground plane and the base element is effected. The impedance of the base element is thus changed, resulting in a change in the delay through the meander line tuning module as the propagation constant. This change in delay tunes the meander line antenna in the same manner as discrete switch elements by adjusting only a single voltage.

Therefore, it is an aspect of this invention to provide a more efficient and robust means of tuning a meander line antenna.

It is another aspect of the invention to provide a method for tuning a meander line antenna that does not rely on a multiplicity of discrete switch elements.

It is a further aspect of the invention to provide a method for tuning a meander line antenna that relies on tuning a single voltage.

These aspects of the invention are not meant to be exclusive and other features, aspects, and advantages of the present invention will be readily apparent to those of ordinary skill in the art when read in conjunction with the appended claims and accompanying drawings.

DETAILED DESCRIPTION OF THE INVENTION

Figure 1:
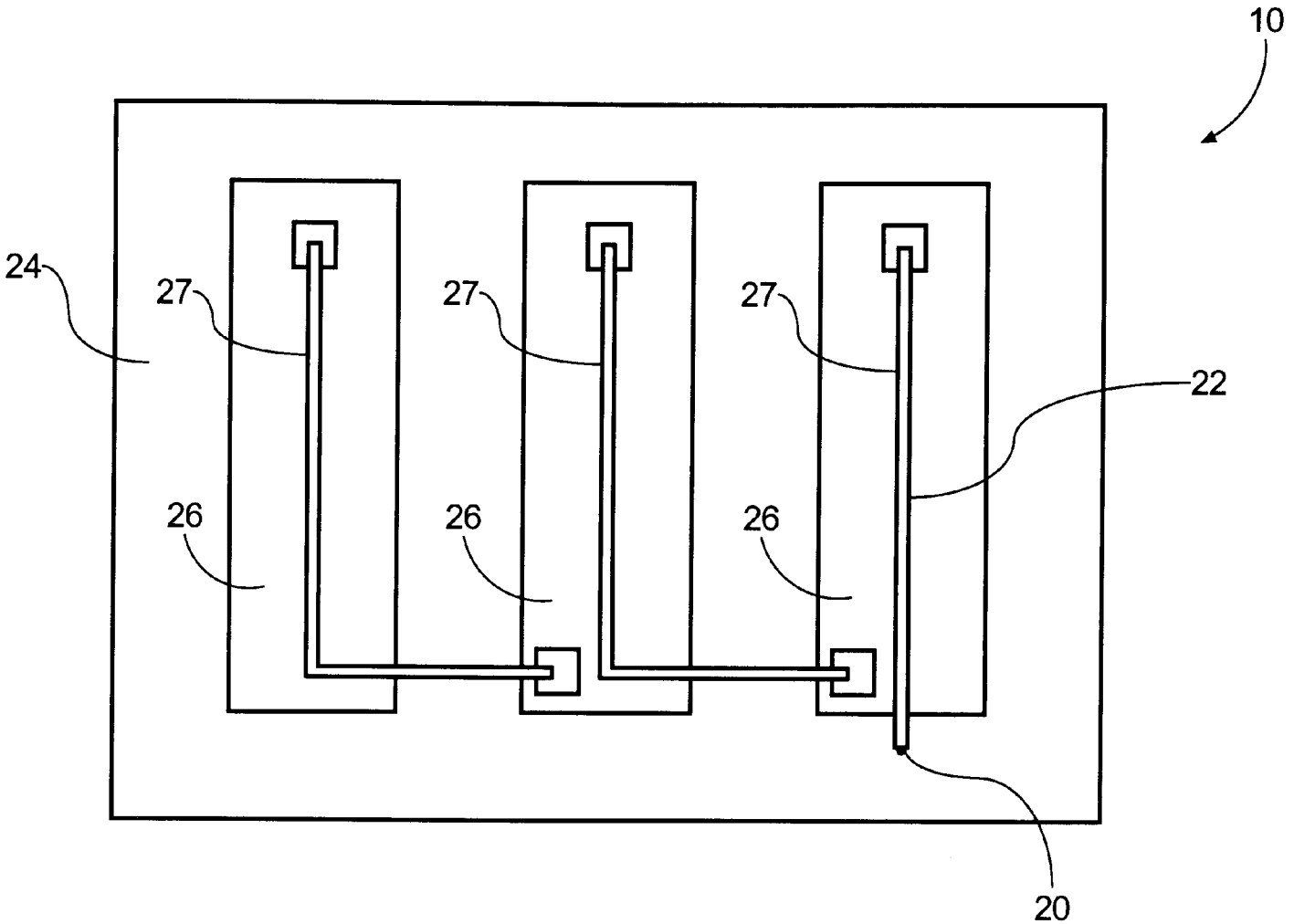
FIG. 1 is a representational perspective view of a meander line tuning module used in a meander line antenna.

Basic meander line tuning module 10 is shown in FIG. 1. Coupler 20 is a slow wave meander line in the form of a folded transmission line 22 mounted on a plate, represented by ground plane 24. Transmission line 22 is constructed from a folded microstrip line including alternating sections, base elements 26 and top elements 27, thereof. Elements 26 and 27 are mounted close to and separated from ground plane 24. The variation in height from ground plane 24 of elements 26 and 27 gives those elements alternating impedance levels with respect to ground plane 24.

Figure 2:
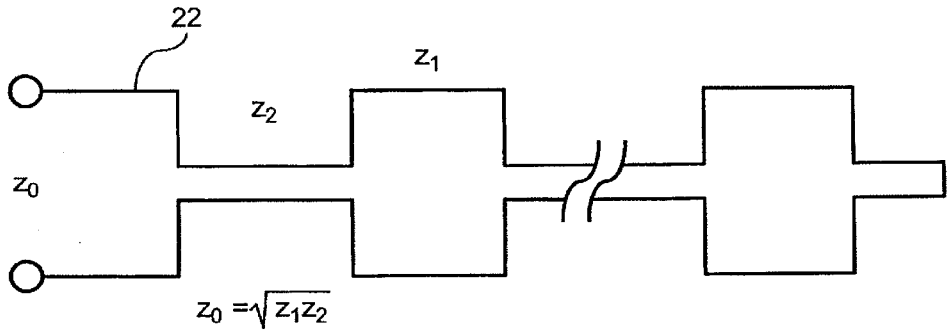
FIG. 2 is a diagram of the electrical image of the tuning module of FIG. 1

Tuning module 10 has propagation constant $\beta$. Propagation constant $\beta$ is proportional to the squareroot of $Z_1$ divided by $Z_2$, as shown in FIG. 2, which is an electrical image of transmission line 22 having alternating lower and higher impedance sections. $Z_1$ is the impedance to ground of the top element, and $Z_2$ is the impedance to ground of the bottom element.

Figure 3:
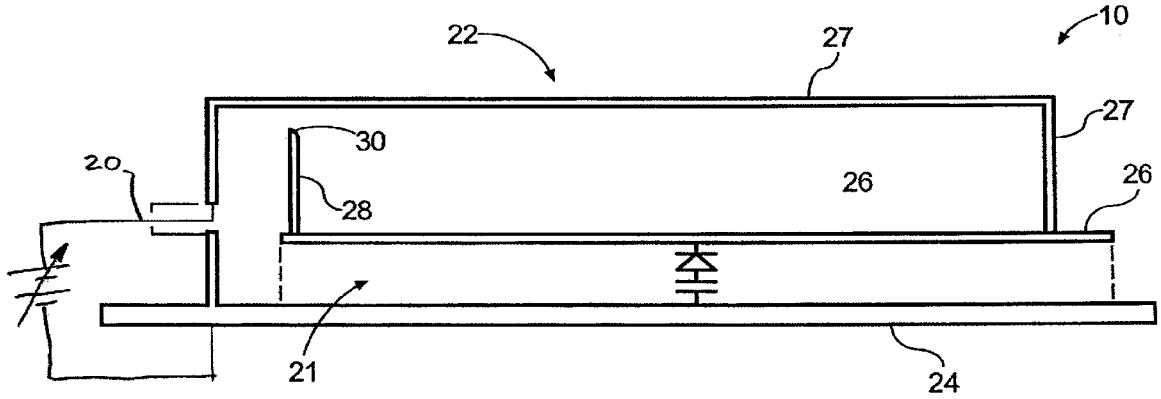
FIG. 3 is a side view of the meander line tuning module of FIG. 1.

FIG. 3 illustrates a side view of tuning module 10. Elements 26 and 27 are interconnected by folded sections 28 of the microstrip line which are mounted in an orthogonal direction with respect to ground plane 24. In this form, transmission line 22 may be constructed as a single continuous microstrip line. End 30 of folded section 28 leads to the next section, as can be seen in FIG. 1.

Base elements 26, which are located close to ground plane 24 to form lower characteristic impedance sections, are electronically insulated from ground plane 24 by means of PN semiconductor layer 21. Top elements 27 are located a controlled distance from ground plate 24, which distance determines the characteristic impedance of the meander line top elements 27 in conjunction with the other physical characteristics of the line as well as the frequency of the signal being transmitted over the line.

As described in FIG. 1, elements 26 and 27 are separated from ground plane 24. PN semiconductor layer 21 is inserted between ground plane 24 and base elements 26. PN semiconductor layer 21 electrically changes the capacitance between ground plane 24 and elements 26 and 27, giving those elements variable impedance levels with respect to ground plane 24.

Applying a dc voltage between base elements 26 and ground plane 24 after inserting PN semiconductor layer 21, a change in capacitance between base element 26 and ground plane 24 is effected. The effect is that of shunting a large number of varactor elements between base elements 26 and ground plane 24. The impedance of base elements 26 is thus changed.

This impedance change is inversely proportional to the change in capacitance. The end result is that the delay through meander line tuning module 10 changes as the propagation constant, which is described in FIG. 2. This change in delay tunes the meander line antenna by simply adjusting the dc voltage applied between base elements 26 and ground plane 24.

Although the present invention has been described with reference to certain preferred embodiments thereof, other versions are readily apparent to those of ordinary skill in the art. Therefore, the spirit and scope of the appended claims should not be limited to the description of the preferred embodiments contained herein.

What is claimed is:

1. An antenna tuning module having a slow wave meander line comprising:

a plate;

a transmission line comprising a folded microstrip line mounted on said plate;

alternating top and base elements disposed along said transmission line, said top elements having a first impedance and said base elements having a second impedance; and a PN semiconductor layer inserted between said plate and said transmission line, said PN semiconductor layer functioning as a voltage variable capacitor;

wherein a voltage is applied between said plate and said base elements, and wherein adjusting said voltage results in changing said second impedance, wherein the slow wave meander line is tuned.

2. A method for tuning a meander line antenna comprising the steps of:

mounting a transmission line on a plate to form a slow wave meander line, said transmission line comprising a folded microstrip line and having alternating top and base elements, said top elements having a first impedance, and said base elements having a second impedance and being located in proximity with said plate;

inserting a PN semiconductor layer between said plate and said base element to form a voltage variable capacitor; and applying a dc voltage between said base element and said plate to change said second impedance;

wherein said slow wave meander line has a propagation constant dependent on said first and second impedances, and wherein said change in said second impedance changes said propagation constant and tunes said antenna.

3. The method as claimed in claim 2 further comprising the step of adjusting said voltage between said base element and said plate, wherein said antenna is tuned to one of a plurality of frequencies.

* * * * *